US006474648B1

(12) United States Patent
Rogers

(10) Patent No.: US 6,474,648 B1
(45) Date of Patent: Nov. 5, 2002

(54) BILLIARDS CARD GAME

(76) Inventor: Rick Rogers, 8225 Riley Hill Rd., Zebulon, NC (US) 27597

( * ) Notice: Subject to any disclaimer, the term of this patent is extended or adjusted under 35 U.S.C. 154(b) by 0 days.

(21) Appl. No.: 09/682,735

(22) Filed: Oct. 11, 2001

(51) Int. Cl.[7] ..... A63F 1/00
(52) U.S. Cl. ..... 273/298; 273/292
(58) Field of Search ..... 273/292, 298, 273/461, 244, 277, 259, 440, 245; 434/128, 129, 247–261

(56) References Cited

U.S. PATENT DOCUMENTS 1,289,511 A * 12/1918 Miller
1,322,954 A * 11/1919 Rosenfeld
3,680,859 A * 8/1972 English ..... 272/22
4,132,411 A * 1/1979 Breslow et al. ..... 273/119 R
4,526,368 A * 7/1985 Furda ..... 273/14
4,793,617 A * 12/1988 Sanon ..... 273/298
4,840,376 A * 6/1989 Garret ..... 273/14
4,878,664 A * 11/1989 Brookes ..... 273/11
5,056,794 A * 10/1991 Simms ..... 273/298
5,163,688 A * 11/1992 Simms ..... 273/298
5,658,202 A * 8/1997 McGovern ..... 473/18
6,276,689 B1 * 8/2001 Brown ..... 273/292

* cited by examiner

*Primary Examiner*—Jessica Harrison
*Assistant Examiner*—Alex F. R. P. Rada, II
(74) *Attorney, Agent, or Firm*—Glasgow Law Firm, PLLC

(57) ABSTRACT

A billiards game having at least one set of cards for directing game play, wherein the cards include picture-based depictions and/or descriptions for a given shot to be attempted by the game player(s). Scoring related to each shot is included on the respective card. Also, a method for playing a billiards game having at least one set of cards for directing game play, wherein the cards include picture-based depictions and/or descriptions for a given shot to be attempted by the game player(s) until the ball(s) are sunk into pocket(s) on the table.

22 Claims, 3 Drawing Sheets

ANGLE SHOT

BANK SHOT

COMBINATION SHOT

BILLIARDS CARD GAME

BACKGROUND OF INVENTION (1) Field of the Invention

The present invention relates generally to games and, more particularly, to a billiards or pool game having cards for use in directing the game play in billiards.

(2) Description of the Prior Art

Prior art billiards-related inventions commonly employ training aid devices to improve a player's ability in the game of billiards, including pocket billiards or pool. Typically, as in U.S. Pat. Nos. 5,520,581 and 4,082,270 these training aids address the difficulties of banking shots, or directing the ball into the cushion edge at a point wherein the angle between the ball before being hit or shot and the cushion is approximately equivalent to the angle between that point on the cushion and the target or desired destination, usually a pocket, of the ball after being hit. Also, in U.S. Pat. No. 4,688,796, an aiming system for billiards is taught for use in playing the game of billiards, which includes a cue stick and system that provides an exact spot for aiming a shot. However, none of these training aids provide any instruction or rules for playing a game of billiards, apart from improving components of a game, namely how to make bank shots or improve shooting skills.

Additional prior art billiards game-based inventions such as taught in U.S. Pat. No. 5,011,147 issued Apr. 30, 1997 to Thomas, et al., provide instructions for playing a particular billiards game having distinct rules; however, as with Thomas, et al., such games often require special equipment, including but not limited to a specialized pool table, including a special table shape and/or additional components like banks or bumpers or specialized pocket placement or construction.

Thus, there remains a need for a billiards game that employs a traditional billiards or pool table and that does not require any specialized billiards equipment.

Finally, a prior art billiards game described in U.S. Pat. No. 6,276,689 includes a combined pool and poker gambling game, more particularly a method for playing a gambling game that involves at least two players. While this prior art reference does not require any specialized billiards equipment, it does require knowledge of more than one game, in particular, more than one game of skill, namely poker and billiards.

Thus, there mains a need for a billiards game that employs a traditional billiards or pool table and that does not require any specialized billiards equipment, and which does not require knowledge or skill in more than one game.

SUMMARY OF INVENTION

The present invention is directed to a billiards or pool game having cards for use in directing the game play in billiards.

By way of summary, in the preferred embodiment, at least one set of cards is employed to direct the game play of billiards, wherein the card set(s) include picture-based descriptions for a given shot to be attempted and made by the game player(s). If the shot is not made by the player who drew that card, then the remaining configuration of billiards balls on the table is to be shot by the next player, and so on, until the ball(s) are sunk into pocket(s). Each shot has an associated difficulty level and respective point(s) that are awarded to the player who either completes the shot as depicted or described on the card or the player who first sinks the ball(s) involved.

Preferably, the at least one set of cards includes shots of different difficulty levels, including combination, angle, bank shots, etc. Also, the shots are preferably configured with respect to the diamonds located on the perimeter of the cushion of the table.

The present invention is further directed to a method for playing a billiards game using cards to direct the game play of billiards.

Thus, the present invention provides a billiards game that employs a traditional billiards or pool table and that does not require any specialized billiards equipment, and which does not require knowledge or skill in more than one game.

Accordingly, one aspect of the present invention is to provide a billiards game having at least one set of cards for directing game play, wherein the cards include picture-based depictions and/or descriptions for a given shot to be attempted by the game player(s). Scoring related to each shot is included on the respective card.

Another aspect of the present invention is to provide a method for playing a billiards game having at least one set of cards for directing game play, wherein the cards include picture-based depictions and/or descriptions for a given shot to be attempted by the game player(s) until the ball(s) are sunk into pocket(s) on the table.

These and other aspects of the present invention will become apparent to those skilled in the art after a reading of the following description of the preferred embodiment when considered with the drawings.

DETAILED DESCRIPTION

Figure 1:
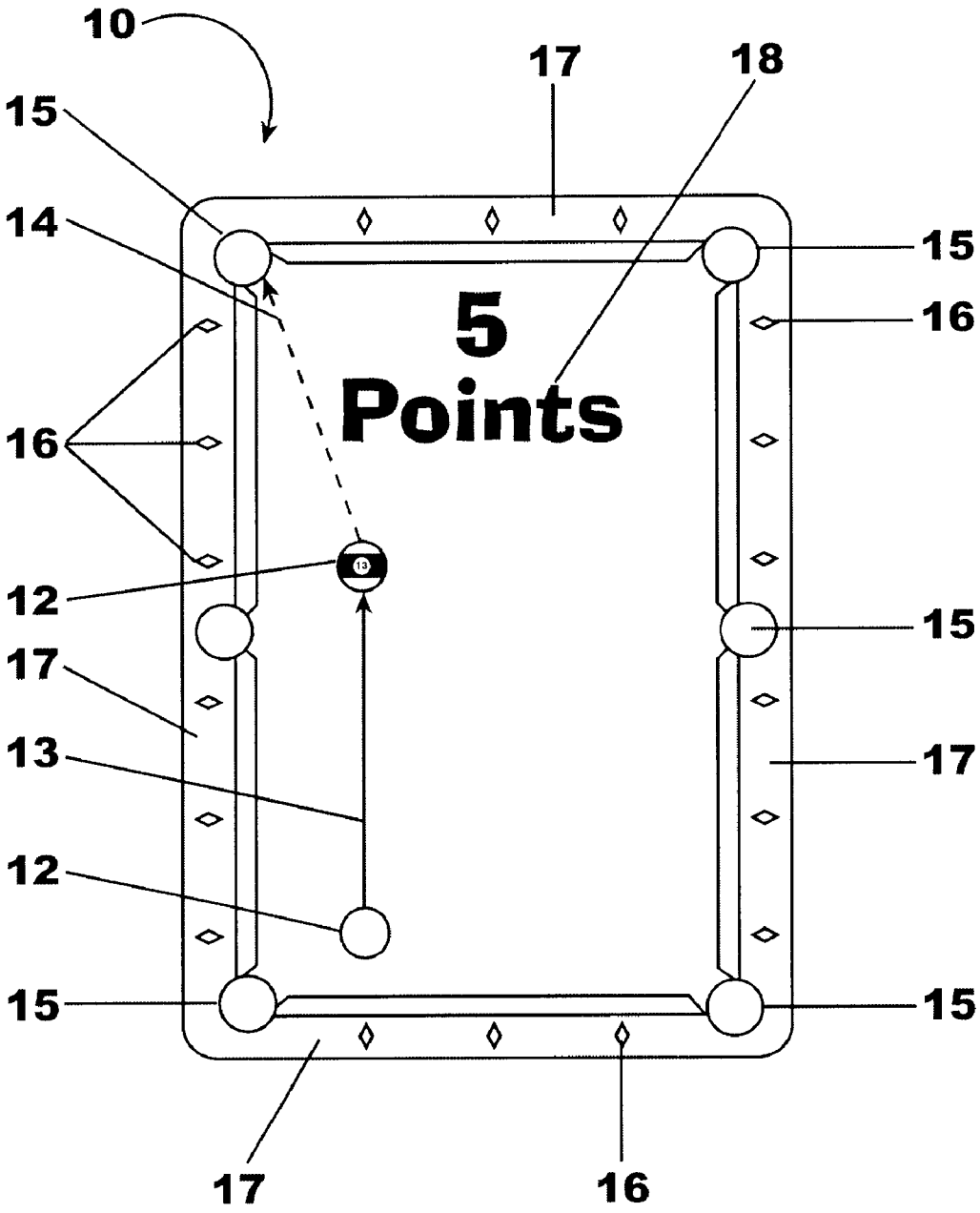
FIG. 1 is a top view of a card example constructed according to the present invention.

In the following description, like reference characters designate like or corresponding parts throughout the several views. Also in the following description, it is to be understood that such terms as "forward," "rearward ," "front," "back," "right," "left," "upwardly," "down wardly," and the like are words of convenience and are not to be construed as limiting terms.

Figure 2:
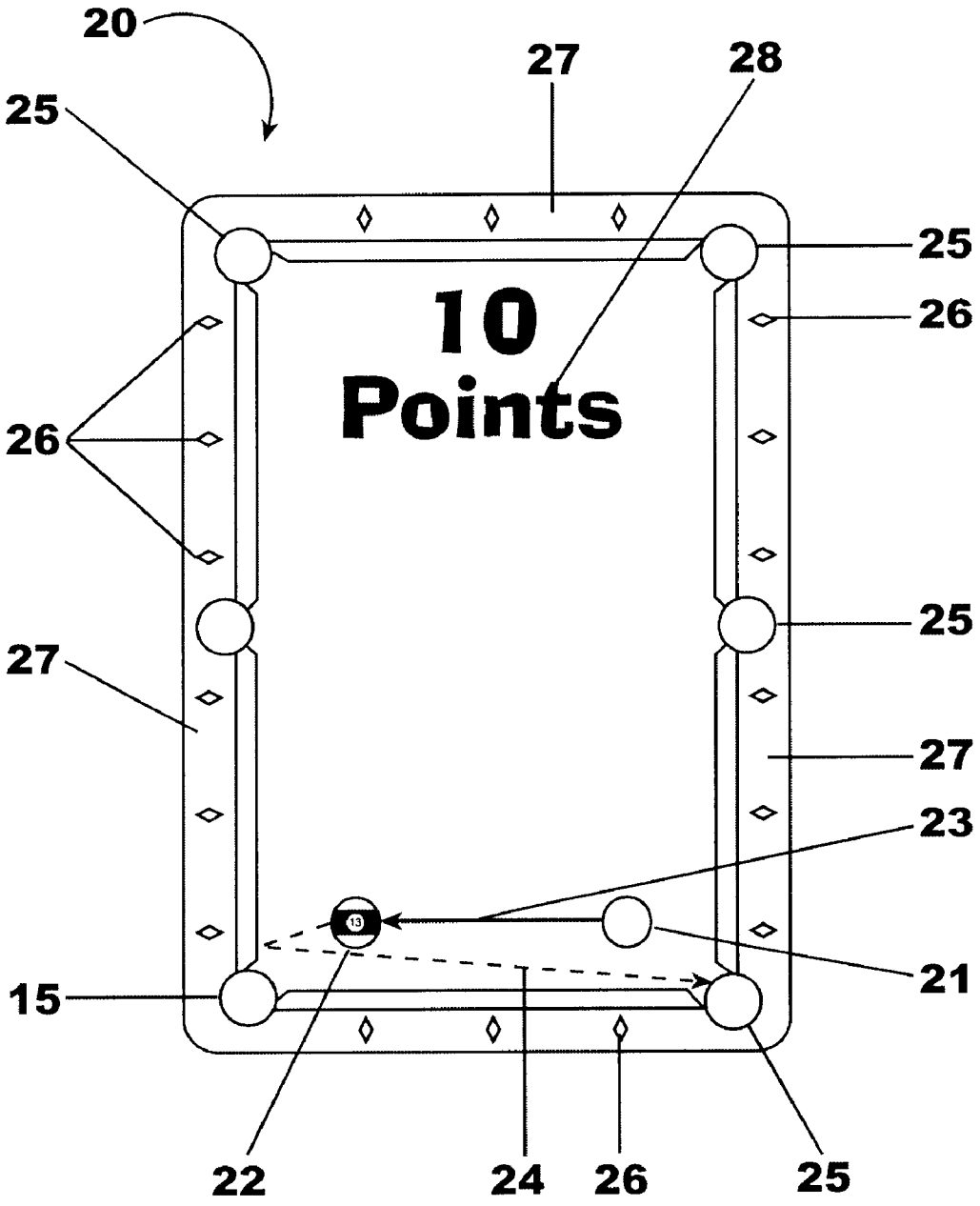
FIG. 2 is a top view of another card example of the present invention.
Figure 3:
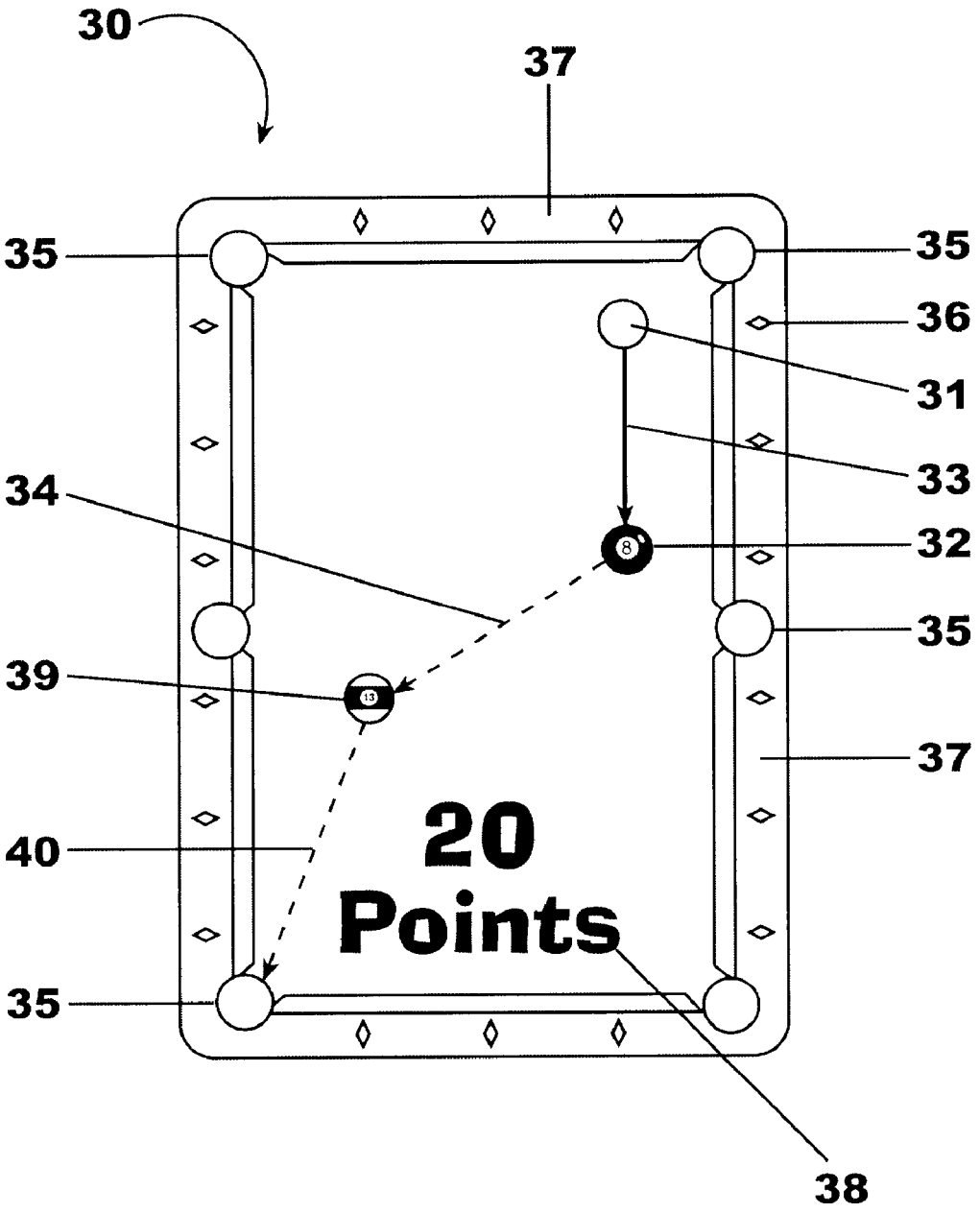
FIG. 3 is a top view of still another card example of the present invention.

Referring now to the drawings in general, the illustrations are for the purpose of describing a preferred embodiment of the invention and are not intended to limit the invention thereto. The game and method according to the present invention require a standard or traditional billiards table and equipment, which includes a rectangular billiards or pool table as shown in FIGS. 1–3, with a smooth, flat surface without bumpers or discontinuities thereon, with six holes or pockets located one at each of the table comers and one centrally located on each of the long sides of the rectangle with a cushion surface or rim or bumper surface along the inner edges of the table that permit a ball to bump into it and continue to travel in a rebounded trajectory without substantial loss or gain of speed, diamond indicators along the edges of the table rim at equally spaced-apart distances for each edge of the rectangular-shaped table; the standard billiards equipment includes at least one free-standing or independent cue stick, a cue ball and additional similarlysized balls for hitting with the cue stick and cue ball across the table surface into the pockets. As best seen in FIG. 1, a card example shown on its top or face side and constructed according to the present invention is shown, generally referenced 10, depicting a given shot for directing game play in billiards or pool. The face side of the card includes a picture- or illustration-based depiction of the shot to be performed. The illustration includes a cue ball 11, at least one ball 12, a preferred shot trajectory line 13, a preferred ball travel trajectory line 14, table pockets 15, and diamond indicators 16 along the cushion surface 17 of a billiards table. A points indicator 18 is included on the face of the card and is associated with the level of difficulty of the shot depicted on the card face 10. FIG. 1 illustrates an angle shot, which is a basic shot in billiards.

FIG. 2 shows another card example, namely a bank shot, on the card's top or face side, generally referenced 20, depicting another shot for directing game play in billiards or pool. Once again, as with FIG. 1, the face side of the card includes a picture- or illustration-based depiction of the shot to be performed. The illustration includes a cue ball 21, at least one ball 22, a preferred shot trajectory line 23, a preferred ball travel trajectory line 24, table pockets 25, and diamond indicators 26 along the cushion surface 27. A points indicator 28 is included on the face of the card and is associated with the level of difficulty of the shot depicted on the card face 20.

FIG. 3 shows yet another card example, namely a combination shot, on the card's top or face side, generally referenced 30, depicting another shot for directing game play in billiards or pool. Once again, as with FIGS. 1 and 2, the face side of the card includes a picture- or illustration-based depiction of the shot to be performed. The illustration includes a cue ball 31, at least two balls 32, 39, a preferred shot trajectory line 33, at least one preferred ball travel trajectory line 34, which includes a first ball preferred travel trajectory line 34 and a second ball preferred travel trajectory line 40, table pockets 35, and diamond indicators 36 along the cushion surface 37. A points indicator 38 is included on the face of the card and is associated with the level of difficulty of the shot depicted on the card face 30. In the case of the combination shot, more than two balls may be used, in which case there are generally a corresponding number of preferred trajectory lines to each ball, e.g., for three balls, then there are generally three preferred trajectory lines, one corresponding to each ball.

Thus, in the preferred embodiment, at least one set of cards, including a multiplicity of cards having different shots depicted and/or described on a face side each of the cards within the at least one set, is employed to direct the game play of billiards, wherein the card set(s) include picture-based descriptions for a given shot to be attempted and made by the game player(s); these picture- or illustration-based descriptions and other descriptions, such as text-based description of a given shot depicted on a given card, provide direction or instruction and a points value associated with each shot. Preferably, the at least one set of cards includes shots of different difficulty levels, including combination, angle, bank shots, etc. Also, the shots are preferably configured with respect to the diamonds located on the perimeter of the cushion of the table.

As set forth in the foregoing, the present invention provides a billiards game including cards for directing game play, wherein the game employs a traditional billiards or pool table and that does not require any specialized billiards equipment, and which does not require knowledge or skill in more than one game. The billiards game using cards to direct the game play of billiards according to the present invention is designed to be played on any standard billiards table using standard billiard balls, cues, and sticks. No special balls or other specialized equipment is required according to the product or method of the present invention. The cards of the present invention are preferably printed on standard playing cards materials, e.g., 2.5"×3.5" cards of C2S, 10 pt. stock paper having a face side and a back side.

In one embodiment of the present invention, a multiplicity of card sets or decks is used. By way of example, not limitation, four different decks of cards may be used. Deck 1 provides cards for directing game play wherein only angle shots are involved. Deck 2 provides cards for directing game play wherein only bank shots are involved. Deck 3 provides cards for directing game play wherein only combination shots are involved. Deck 4 provides cards for directing game play wherein angle shots, bank shots, and combination shots are all involved. Each of the four decks includes at least one card having game instructions printed thereon; approximately forty-five (45) cards depicting different shots are included in the rest of the card set or deck. Each card has a point value associated with the shot.

The present invention also includes a method for playing a billiards game using cards to direct the game play of billiards. In a preferred embodiment, the game is played by at least one player, preferably at least two players who take turns drawing a card from a deck or set of cards. Where one player is playing alone, that player is obviously not competing but is working to improve his/her skills for the types of shot (s) within each of the at least one sets or decks of cards used.

For a given turn for each player, a card is drawn from the deck and the billiards shot is arranged or set up on a standard billiard table as depicted and/or described on the card face. The shot is attempted by the player who drew that card. If the shot is made by that player, then that player retains that card for the successfully completed shot and continues to draw cards, arranging and attempting shots until s/he misses, at which time the turn is passed to the next player.

If the shot is not made by the player who drew that card, then the card is passed to the next player and the remaining configuration of billiards balls on the table is to be shot by the next player, and so on, until the ball(s) are sunk into pocket(s). The next player is permitted to call any shot appropriate for the configuration of ball(s) on the table; preferably, a shot must still be called or indicated prior to a shot being attempted, as with conventional rules of billiards, although it need not be the same shot depicted or described on the card. In this manner of playing, a lesser player may win points and eventually an entire game over a more skilled player who misses a shot, since the points for the shot eventually made (which is not necessarily the shot described or illustrated on the card drawn) correspond to the points indicated on the card drawn, which is passed to the next consecutive player if the first player misses the initial shot. Also, if a scratch, or sinking of the cue ball, occurs where a shot is made, then the card is passed to the next player, who keeps the card and its associated points and gets to draw the next card; if a scratch occurs where a shot is missed, then general rules of pool apply, i.e., the next player positions the cue ball and attempts a shot with the remaining ball(s) in their left-over configuration. Also, if a shot is missed, then the card and the turn passes to the next player. The game continues until all cards have been played; at the end of the game, the player with the most points, as calculated from the cards retained by each player, wins.

Each shot has an associated difficulty level and respective point(s) that are awarded to the player who either completes the shot as depicted or described on the card or the player who first sinks the ball(s) involved. The player may keep the card for each shot that s/he makes to provide a total score based upon the total successful shots. For combination shots, all balls pictured must be made; the player making the final ball receives the points for that shot, and draws the next card to continue play. While each shot is in play, general rules of billiards apply.

In a preferred embodiment of the present invention, easy shots are worth five (5) points, intermediate difficulty shots are worth ten (10) points, and difficult shots are worth twenty (20) points. At least one wildcard may be included in each deck, worth twenty-five (25) points. The player with the most accumulated points at the end of the game is the winner; the game ends when the deck is completed, i.e., all cards have been drawn and played.

Certain modifications and improvements will occur to those skilled in the art upon a reading of the foregoing description. By way of example, a plurality of card sets may be used for different levels of difficulty. Also, variations in the number of cards used to play a given game may be selected, e.g., 15 shots, 30 shots, or 45 shots corresponding to the number of cards in a deck or set. Additionally, a deck may be played in a randomized manner, i.e., by mixing the cards within a deck for randomization, or in an ordered manner, e.g., by arranging the cards within a given deck according to the number of points for each card or shot from easiest to most difficult. Also, as set forth in the foregoing, the game may be played individually by one player in order to improve his/her skills at billiards for the shots depicted on the cards.

The cards may also be manufactured from different card stock, have different dimensions, different point values, and the like without departing from the present invention and the scope of the following claims.

All modifications and improvements have been deleted herein for the sake of conciseness and readability but are properly within the scope of the following claims.

What is claimed is:

1. A billiards game for directing game play comprising at least one set of cards, wherein each card of the set has a face side which identifies a given shot to be attempted by at least one game player using a standard billiards table and equipment.

2. The billiards game according to claim 1, wherein the face side of each card includes an illustration of the shot to be attempted.

3. The billiards game according to claim 2, wherein the illustration includes an arrangement of at least one ball positioned on the table with respect to diamond indicators located along the cushion surface of the table.

4. The billiards game according to claim 3, wherein the illustration includes at least one preferred trajectory line corresponding to the at least one ball.

5. The billiards game according to claim 3, wherein the illustration includes a cue ball; at least one ball; a preferred shot trajectory line corresponding to the cue ball; and at least one preferred ball travel trajectory line corresponding to the at least one ball, respectively.

6. The billiards game according to the claim 2, wherein the shot identified includes a cue ball and at least one ball.

7. The billiards game according to claim 1, wherein the shot is selected from the group consisting of an angle shot, a bank shot, a combination shot, and combinations thereof.

8. The billiards game according to claim 1, wherein each card has a different shot and a points level associated with therewith, which is indicated on the face side of the card.

9. The billiards game according to claim 1, wherein the face side of each card includes a description of the shot to be attempted.

10. The billiards game according to claim 1, wherein the face side of each card includes an illustration and a description of the shot to be attempted.

11. The billiards game according to claim 1, wherein the at least one set of cards has a multiplicity of cards in each set.

12. The billiards game according to claim 11, wherein each card has a different shot identified on a face side thereof.

13. The billiards game according to claim 1, wherein the at least one set of cards has an instructional card included in the set for describing the rules and how to play the game.

14. The billiards game according to claim 1, wherein the at least one set of cards has at least one wildcard included in the set.

15. The billiards game according to claim 1, wherein the set of cards is drawn by the at least one player in a random order.

16. The billiards game according to claim 1, wherein the set of cards is arranged and drawn by the at least one player in an order of increasing difficulty of shots.

17. A method for playing a billiards game comprising the steps of a) providing at least one set of cards identifying a given shot to be attempted by at least one game player;

b) a first of at least one game player selecting a first card from the set of cards;

c) arranging billiard balls on a billiard table according to the given shot identified on a face side of the first card;

d) the first of at least one game player attempting the shot as arranged on the table;

e) where the shot is successfully completed by the first game player, the player retaining the card and its associated points;

f) where the shot is not successfully completed by the first game player, the first game player passing the card to a next player, if any, who attempts the remaining shot on the table;

g) repeating step (f) until the balls are sunk into pockets, wherein the last player who completes the shot retains the card and its associated points;

h) drawing another card from the at least one set of cards;

i) repeating steps (c) through (g);

j) repeating the steps through (i) until all cards are played.

18. The method according to claim 17, further including the step of calculating a winning score by adding the points for all cards held by each player, wherein the highest score is the winning score.

19. The method according to claim 17, wherein the at least one player is at least two players.

20. The method according to claim 17, wherein the at least one set of cards has a multiplicity of cards in each set and each card has a different shot identified on a face side thereof.

21. The method according to claim 17, wherein the set of cards is drawn by the at least one player in a random order.

22. The method according to claim 17, wherein the set of cards is arranged and drawn by the at least one player in an order of increasing difficulty of shots.

* * * * *